US010881900B2

(12) United States Patent
Brask

(10) Patent No.: US 10,881,900 B2
(45) Date of Patent: Jan. 5, 2021

(54) NECK TRAINING APPARATUS

(71) Applicant: NECKFOCUS AS, Rolvsoy (NO)

(72) Inventor: Bent Brask, Rolvsoy (NO)

(73) Assignee: NECKFOCUS AS, Rolvsoy (NO)

( * ) Notice: Subject to any disclaimer, the term of this patent is extended or adjusted under 35 U.S.C. 154(b) by 0 days.

(21) Appl. No.: 15/761,730

(22) PCT Filed: Sep. 22, 2016

(86) PCT No.: PCT/NO2016/050192
§ 371 (c)(1),
(2) Date: Mar. 20, 2018

(87) PCT Pub. No.: WO2017/052382
PCT Pub. Date: Mar. 30, 2017

(65) Prior Publication Data

US 2018/0353806 A1 Dec. 13, 2018

(30) Foreign Application Priority Data

Sep. 22, 2015 (NO) ..... 20151238

(51) Int. Cl.
*A63B 23/025* (2006.01)
*A63B 21/00* (2006.01)
(Continued)

(52) U.S. Cl.
CPC ..... *A63B 23/025* (2013.01); *A61G 7/072* (2013.01); *A61G 13/121* (2013.01);
(Continued)

(58) Field of Classification Search
CPC . A63B 23/025; A63B 21/156; A63B 21/4039; A63B 21/4047; A63B 21/4003;
(Continued)

(56) References Cited

U.S. PATENT DOCUMENTS 2,633,125 A * 3/1953 Yellin ..... A61F 5/04 602/36
2,658,506 A * 11/1953 Haskell ..... A61H 1/0218 602/32
(Continued)

FOREIGN PATENT DOCUMENTS

CN 201315445 Y 9/2009
CN 102973383 A 3/2013
(Continued)

OTHER PUBLICATIONS

Examination Report No. 1 for Australian Patent Application No. 2016327434 dated Apr. 5, 2019, 5 pages.
(Continued)

*Primary Examiner* — Andrew S Lo
(74) *Attorney, Agent, or Firm* — Withrow & Terranova, P.L.L.C.; Vincent K. Gustafson

(57) ABSTRACT

Apparatus for exercise the musculature and mobility of the joints in the neck wherein the apparatus comprises an upper part 4, a bottom part and a connecting element 3 connecting the upper and the bottom part, and wherein the upper part 4, the bottom part and the connecting element 3 defines a space in which the head of a user can be placed, characterized in that to the upper part 4 there is attached a cradle 5 in which the head of the user can rest and the lower part has attached a pillow for neck support 2.

14 Claims, 4 Drawing Sheets

(51) Int. Cl.

| | |
|---|---|
| ***A63B 21/04*** | (2006.01) |
| ***A63B 21/02*** | (2006.01) |
| ***A61H 1/02*** | (2006.01) |
| ***A63B 21/055*** | (2006.01) |
| ***A61G 7/07*** | (2006.01) |
| ***A61G 13/12*** | (2006.01) |

(52) U.S. Cl.

CPC ..... *A61H 1/0296* (2013.01); *A63B 21/00069* (2013.01); *A63B 21/02* (2013.01); *A63B 21/0442* (2013.01); *A63B 21/154* (2013.01); *A63B 21/156* (2013.01); *A63B 21/4039* (2015.10); *A63B 21/4045* (2015.10); *A63B 21/4047* (2015.10); *A61H 2001/0203* (2013.01); *A61H 2201/1607* (2013.01); *A61H 2201/1611* (2013.01); *A61H 2201/1669* (2013.01); *A61H 2205/04* (2013.01); *A63B 21/0552* (2013.01); *A63B 2208/0252* (2013.01)

(58) Field of Classification Search

CPC ..... A63B 21/4049; A63B 21/4045; A63B 21/00069; A63B 21/54; A63B 21/0442; A63B 21/02; A63B 2208/0252; A63B 21/0552; A61G 13/121; A61G 7/072; A61H 1/0296; A61H 2205/04; A61H 2201/1669; A61H 2201/1611; A61H 2201/1607; A61H 2001/0203; A61H 1/0218

See application file for complete search history.

(56) References Cited

U.S. PATENT DOCUMENTS

| | | | | | |
|---|---|---|---|---|---|
| 2,831,482 | A * | 4/1958 | Cobb | A61H 1/0218 | 602/33 |
| 3,298,364 | A * | 1/1967 | Radford | A61H 1/0218 | 602/33 |
| 3,359,976 | A * | 12/1967 | Laval, Jr. | A61F 5/055 | 602/36 |
| 3,662,750 | A * | 5/1972 | Jorgensen | A61F 5/04 | 602/35 |
| 3,856,003 | A | 12/1974 | Pfluger | | |
| 4,236,265 | A | 12/1980 | Carradine | | |
| 4,278,249 | A | 7/1981 | Forrest | | |
| 4,356,816 | A * | 11/1982 | Granberg | A61H 1/0222 | 606/241 |
| 4,466,427 | A * | 8/1984 | Granberg | A61H 1/0218 | 606/243 |
| 4,538,598 | A * | 9/1985 | Gill | A61H 1/0218 | 602/33 |
| 4,956,881 | A | 9/1990 | Lindley et al. | | |
| 5,451,202 | A | 9/1995 | Miller et al. | | |
| 6,113,563 | A * | 9/2000 | D'Amico | A61H 1/0218 | 602/32 |
| 6,511,450 | B1 | 1/2003 | Bauermeister | | |
| 7,144,380 | B2 * | 12/2006 | Gilliam | A61F 5/04 | 602/36 |
| 7,862,526 | B1 * | 1/2011 | Skowron | A61H 1/0218 | 602/18 |
| 8,613,690 | B1 * | 12/2013 | Thompson | A63B 23/025 | 482/10 |
| 2009/0306567 | A1 * | 12/2009 | Meyer | A61H 1/0218 | 602/33 |
| 2010/0292051 | A1 | 11/2010 | Benumof et al. | | |
| 2014/0046371 | A1 * | 2/2014 | Fisher | A61H 1/0292 | 606/240 |
| 2014/0249461 | A1 * | 9/2014 | Bissell | A61H 1/0218 | 602/36 |
| 2014/0336004 | A1 * | 11/2014 | Gittleson | A63B 23/025 | 482/10 |

FOREIGN PATENT DOCUMENTS

| | | | |
|---|---|---|---|
| WO | 96025205 | A1 | 8/1996 |
| WO | 2010039105 | A1 | 4/2010 |
| WO | 2011101846 | A1 | 8/2011 |
| WO | 2012095542 | A1 | 7/2012 |
| WO | 2014033633 | A2 | 3/2014 |

OTHER PUBLICATIONS

International Search Report (Form PCT/ISA/210) for International Application No. PCT/N02016/050192, dated Dec. 23, 2016, 3 pages.

Office Action in Norwegian Patent Application No. 20151238 dated Mar. 3, 2016, 3 pages.

Translation of First Notification of Office Action for Chinese Patent Application No. 201680055281.8 dated Nov. 21, 2019, 10 pages.

* cited by examiner

NECK TRAINING APPARATUS

CROSS-REFERENCE TO RELATED APPLICATION(S)

This application is a 35 U.S.C. § 371 national phase filing of International Application No. PCT/NO2016/050192 filed Sep. 22, 2016, and claims the benefit of Norwegian Patent Application No. 20151238 filed Sep. 22, 2015 in the Norwegian Industrial Property Office, wherein the disclosures of the foregoing International and Norwegian applications are hereby incorporated by reference herein in their respective entireties.

TECHNICAL FIELD

The present invention regard an apparatus and a method for exercising musculature, and restore joint mobility in the neck, and more particularly an apparatus and a method for exercising the musculature and restoring joint mobility in the neck through controlled motion of the head and the neck along three axes.

BACKGROUND OF THE INVENTION

Whiplash is the most common non-lethal injury in car accidents in the world. 430,000 people made an insurance claim for whiplash in 2007, in the UK alone.

The term "whiplash" is a non-medical term that describes a wide range of injuries to the neck that is usually caused by a sudden distortion of the neck associated with extension.

The severity of a whiplash injury ranges from mild pain for a few days, which is the case for most people, to severe disability. About 50% who have whiplash injuries from a car accident will have some long lasting problems.

If an injured person has symptoms lasting for more than six months after the accident, he or she is usually diagnosed with whiplash syndrome.

The method for treating people with whiplash injuries has changed a lot over the years. Earlier it was more common to treat the patients with a collar, either soft or hard.

However, research of later years has concluded that the best way of recovery is to use an active rehabilitation program including physical therapy exercises and postural modifications.

In fact, it is important to begin rehabilitation immediately to prevent future pain, and the main purpose with early rehabilitation is to reduce the risk for development of Whiplash syndrome.

Current research supports that active mobilization rather than a collar results in a more prompt recovery in both the short- and long-term perspective and patients who participated in active therapy shortly after injury increased their mobilization of the neck and had significantly less pain within four weeks than patients using a collar.

Active treatments are light repetitive exercises of the neck and they can be done either at home or under the care of a health professional.

When beginning a rehabilitation regimen, it is important to begin with slow movements, which include cervical rotation until pain threshold three to five times per day, flexing and extension of the shoulder joint by moving the arms up and down two to three times, and combining shoulder raises while inhaling and releasing the shoulder raise while exhaling.

Passive treatments such as acupuncture, massage therapy, and stimulation may sometimes be used as a complement to active exercises. Return to normal activities of daily living should be encouraged as soon as possible to maximize and expedite full recovery.

Due to these changes in the way of treating patients suffering from a whiplash injurie, several types of exercise equipment have been designed.

US 2010292051 A1 is an example of exercise equipment made for whiplash recovery. The equipment is a portable neck exercise apparatus. The apparatus is meant to be carried on your back. A headband connects the users head to the apparatus. The headband is connected to a set of wires and an adjustable mechanism makes it possible to adjust the tension on the neck. The user exercises the neck by moving the head back and forth.

There are several problems and drawbacks with this solution. One problem is that the apparatus needs to be carried on the back. It is a large, heavy and bulky apparatus that can only be used while the user is standing. A further problem is that it is only possible to exercise the neck by tilting the head back and forth. This results in that the neck can only be exercised in one direction. Yet another problem is that the apparatus uses restraints to exercise the neck. This increases the danger of exercise related injuries.

Also FR 3005582 A1 describes an apparatus intended to help with the treatment of neck related injuries. Also this device is meant to be carried on the back of the user. In this device the back of the head rests on a support. The neck is exercised by pushing the head against the support.

The problem with this solution is much the same as with US 2010292051 A1. The device can only be used while the user is standing. It is large, heavy and bulky, it only exercises the neck in one direction and it uses a restraining motion on the neck, increasing the dangers of injuries.

SUMMARY OF THE INVENTION

It is therefore an objective of the present invention, as presented in the set of claims, to solve the problems mentioned above.

The present invention solves the problems by exercising the head and neck with using little or no tension, and further the movement of the head and neck is isolated along a fixed set of axes. It is therefore possible to exercise the motion, and the range of the motion of the head and neck around one axis of movement at a time. The apparatus is meant for use while the patient is lying on a flat hard surface like the floor. The base of the apparatus rests on the floor and has, in one end, a support for the neck. Further, there is a cradle attached to the upper part of the apparatus. This cradle supports the head and gives the patient full range of motion while at rest. This cradle is attached to the upper structure via a set of pulleys and joints. These pulleys and joints allow the user movement of the head and neck around several axes.

The present invention therefore solves the problem of exercising the head and neck with an apparatus where it is possible to use movement without tension or a controlled amount of tension, and further exercise the range of motion around one axis of movement at a time.

DETAILED DESCRIPTION

Figure 1:
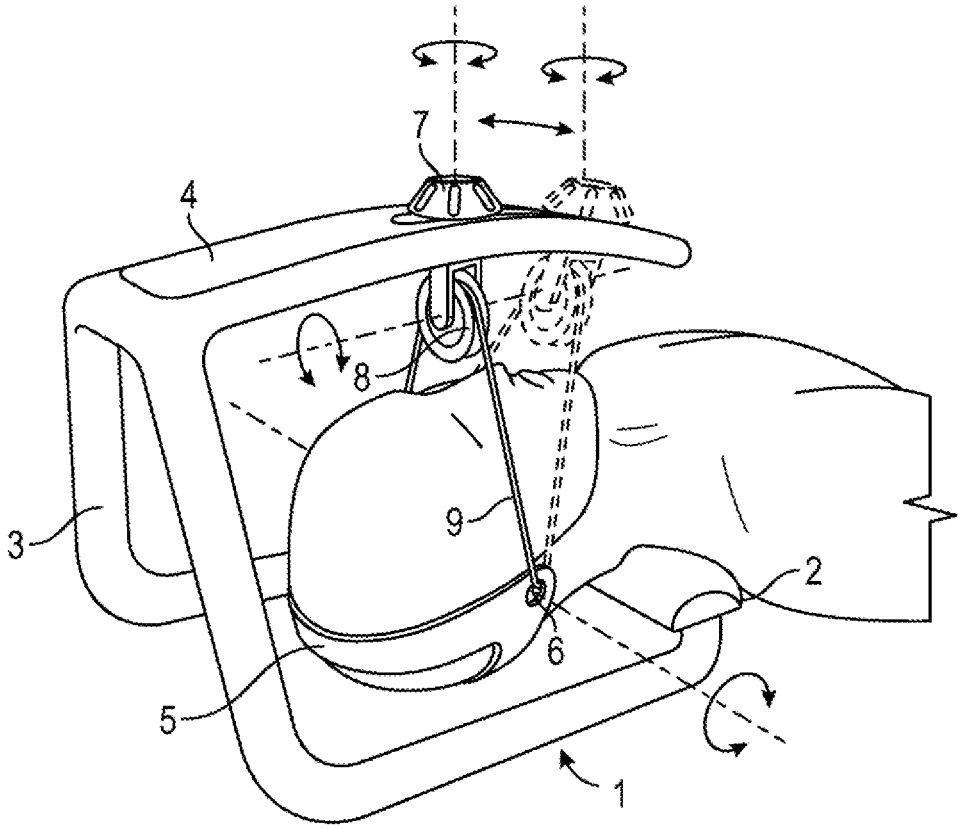
FIG. 1 is a perspective view of a first embodiment of the present invention.

FIG. 1 is a perspective view of the first embodiment of the present invention.

The present invention is an apparatus for exercising the head and neck of a person, either without using tension, or using a controlled amount of tension. It is further an object of the present invention to give the user the ability to isolate the movement of the head and neck around one axis of movement at a time.

The apparatus comprises a base 1. In a first end of the base 1, there can be attached a neck support 2. The neck support 2 can be in the form of a cushion. In a second end of the base 1, at least one connecting element 3 connects the base 1 to the upper part of the apparatus. The neck support 2 can be moved up and down the neck and provides fixation of movement so that the axis movement becomes more specific.

The upper part has an elongated shape stretching approximately the same length of the base 1. It can bend downward at the end.

The base 1, the connecting element 3 and the upper part 4 of the apparatus define a space at least large enough to receive a human head.

A cradle 5 is connected to the upper part 4 of the apparatus. The cradle 5 gives rest and support to the head of the user. The cradle 5 has a band going around the back of the head. A further band goes over the top of the head. These two bands give support to the head and make it possible for the user to rest their head. The two bands meet at each side of the head. At each meeting point the cradle 5 is attached to a wire 9, a rope or similar. The wire 9 or rope runs from the first attachment point 6 over a connection point between the wire 9 or rope and the upper part 4 of the apparatus and to the second attachment point 6.

The attachment points 6 between the wire 9 and the cradle 5 can be a joint. These joints allow the cradle 5 to rotate around an axis defined as going thru the centre of both attachment points 6. This movement makes it possible to move the head and neck around a first axis. This first axis is between the skull and the first vertebra. The movement is defined as moving the head up and down, like in a nodding motion.

The connection point between the wire 9 or rope and the upper part 4 of the apparatus can preferably be a rolling element like a pulley 8 or a wheel. This pulley 8 or wheel allows for movement of the head and neck around a second axis. This second axis is defined as being parallel to an axis going thru the centre of the pulley 8 or wheel. This axis allows the user to move the head from side to side in a rotation movement from side to side as the body language of saying no, no. Like in a shaking motion. The movement axis is centred around the first and second vertebra.

Alternatively the connection point can be a track in which the wire 9 or rope can slide with as low friction as possible.

This connection point between the wire 9 or rope and the upper part 4 of the apparatus can be attached to a slide able mechanism 7. This slide able mechanism 7 allows the user to adjust the angle of the wire 9 relative to the third axis. This slide able mechanism 7 allows the user to target the movement to certain vertebrae and especially the third to seventh vertebrae.

The rolling element is preferably mounted to the upper part 4 of the mechanism via a joint. This joint makes it possible to isolate the movement of the head and the neck around a third axis. This axis is defined as going thru the centre of the head from the face to the back of the head. The centre of the axis is moved downward the neck as the slide mechanism is moved along the upper part 4. The motion around this axis is tilting the head from side to side.

Figure 2:
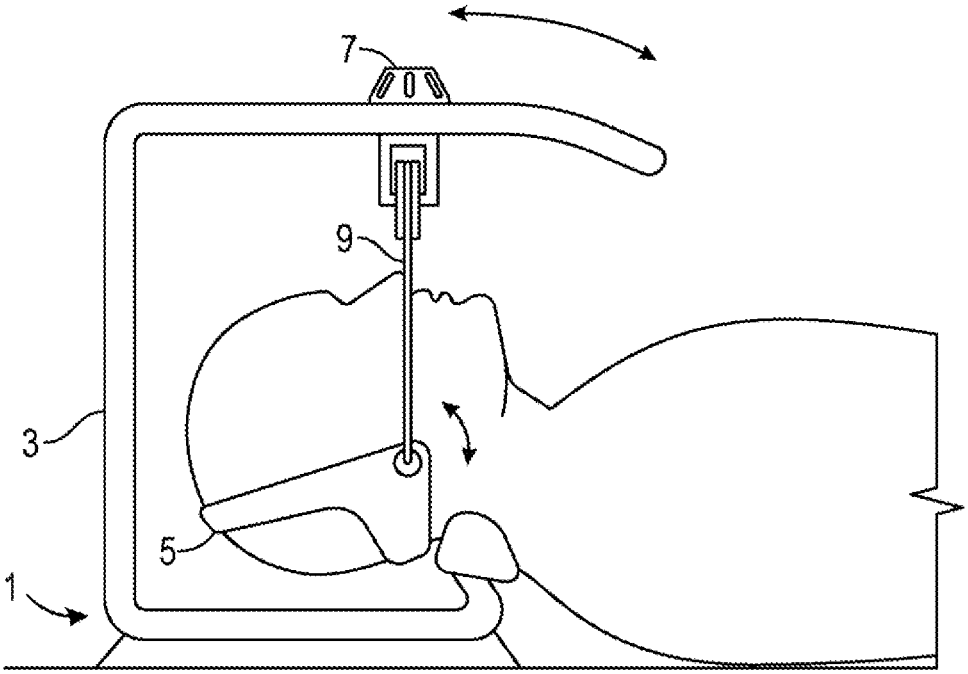
FIG. 2 is a side view of the first embodiment of the present invention, showing how motion of the head and neck is isolated along a first axis, further it is shown how the range of motion around this axis is controlled.

FIG. 2 is a side view of the first embodiment of the present invention, showing how motion of the head and neck is isolated along a first axis. A tightening screw is situated on top of the upper part 4 of the apparatus. This tightening screw makes it possible to lock the slide able mechanism 7 in a certain position.

The arrow A shows how it is possible to adjust the angle of the wire 9 relative to the third axis. This slide able mechanism 7 allows the user to target the movement to certain vertebrae. It is the axis for side bending that moves down the neck as the attachment is moved outward.

Figure 3:
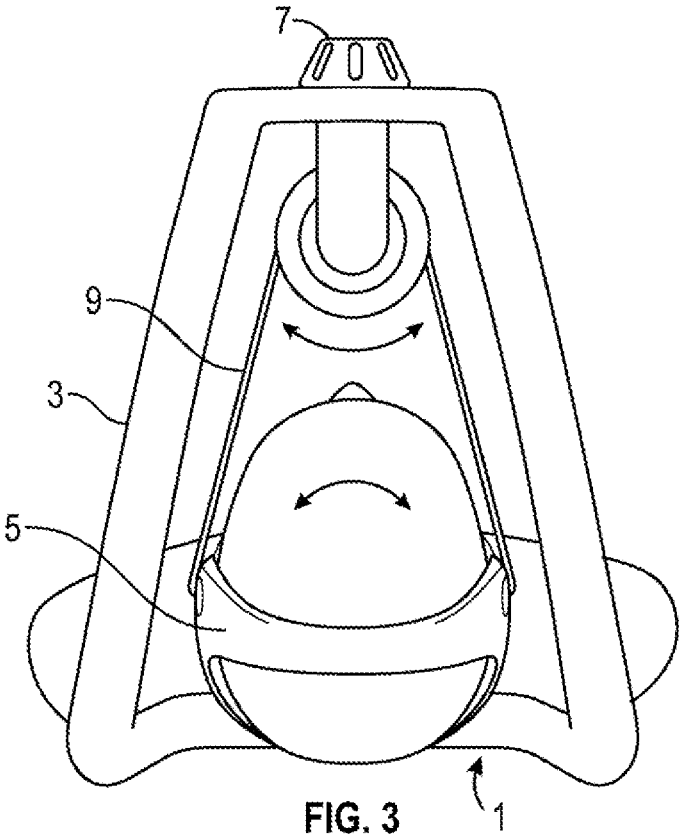
FIG. 3 is a front view of the first embodiment of the present invention, displaying how motion of the head and neck is isolated along a second axis.

FIG. 3 is a front view of the first embodiment of the present invention. Here it is shown the apparatus with a person resting the head in the cradle 5. At top, the tightening screw that makes it possible to lock the slide able mechanism 7 in a certain position is situated. The slide able mechanism 7 is attached to a pulley 8 or a wheel. The pulley 8 or wheel rotates as the wire 9 or rope is pulled from side to side. The wire 9 or rope is attached at each end to the cradle 5. When the user moves the head from side to side in a shaking motion, the wire 9 or rope turns the pulley 8 or wheel around. This allows for the movement of the head around a second axis.

Figure 4:
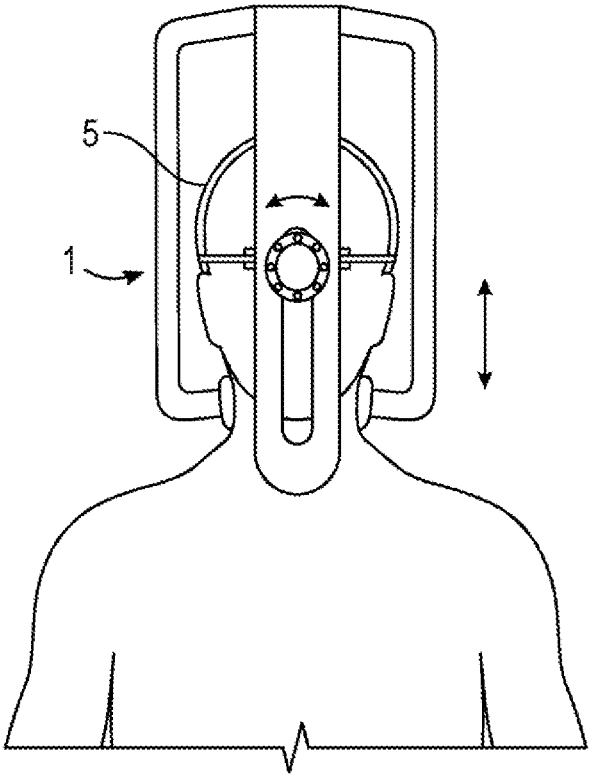
FIG. 4 is a top view of the first embodiment of the present invention, showing how motion of the head and neck along a third axis is isolated.

FIG. 4 is a top view of the first embodiment of the present invention, showing how motion of the head and neck along a third axis is isolated. The arrow B displays how the head is moved from side to side in a tilting motion. This motion secures a movement around the third axis. Further, it is shown how the slide able mechanism 7 is placed in a slit running either part of the length of the upper part 4 of the apparatus or the entire length of the upper part 4 of the mechanism.

The slit is only an example of how the slide able mechanism 7 can move along the length of the upper part 4 of the apparatus. Several other solutions will be apparent to a person skilled in the art.

Further, the cradle 5 can also be made in several other ways, e.g. as one continuous piece instead of two different bands. Further, it can also be thought that only one band can be used instead of two.

The rolling element can be attached to the upper part 4 in several ways and also with a connecting rope between the rolling element and the upper structure.

In addition, it will be apparent for a person skilled in the art that the apparatus itself can be constructed in several ways. The parts can be made by tubes, rods, bars, and plates or similar. The number of connecting element 3 between the upper part 4 of the apparatus and the bottom can also vary in number. Even the material that the apparatus is made of can vary, either being metal, plastic, wood or any combination. It is also possible to make the apparatus either flexible or stiff, depending on the suspension and flexibility of the apparatus.

FIGS. 5*a*-5*d* show different embodiments of the present invention. In these embodiments are different attachment point 6*s* for between the wire 9 or rope and the cradle 5. There are several ways of solving the movement of the cradle 5 around the axis going through both of the attachment point 6*s*.

Figure 5A:
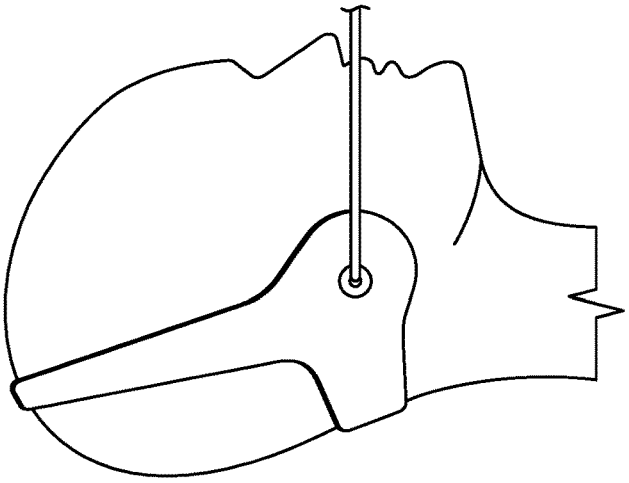
FIG. 5*a*-5*d* shows different embodiments of the present invention.

FIGS. 5*a* displays an embodiment where the wire 9 or rope is fixed to the cradle 5. The movement in this solution is secured by the flexibility of the wire 9 or rope.

Figure 5B:
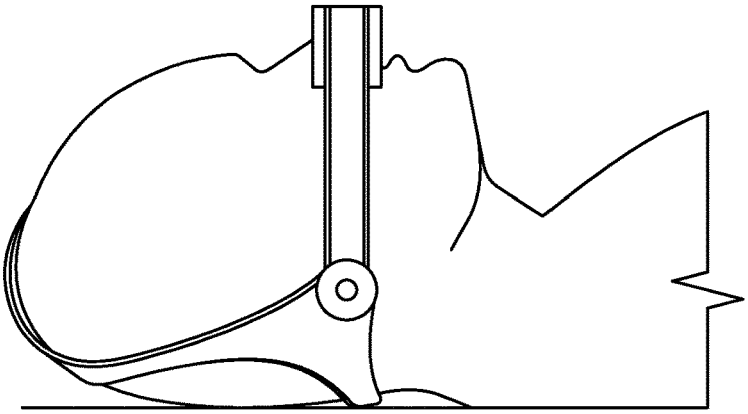

FIG. 5*b* displays another embodiment where the movement in the attachment point 6 is secured by the wire 9 or rope being fixed to a joint element. The joint element is rotatably attached to the cradle 5.

Figure 5C:
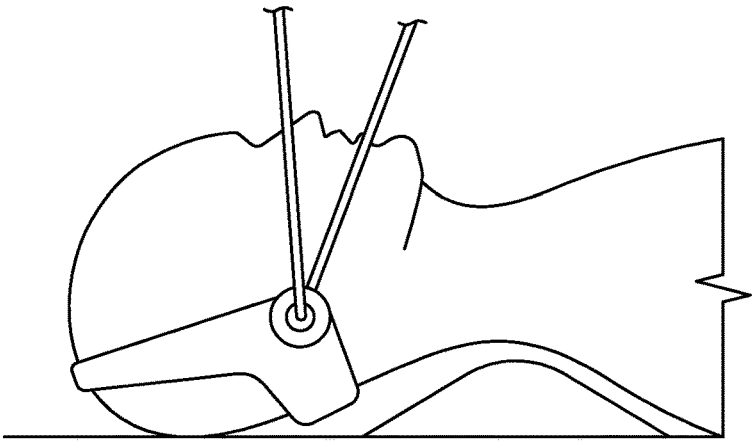

FIG. 5*c* displays yet another embodiment of the attachment point 6 between the wire 9 or rope and the cradle 5. In this solution, the joint element is fixed to the cradle 5 and the attachment point 6 to the wire 9 or rope is rotatable.

Figure 5D:
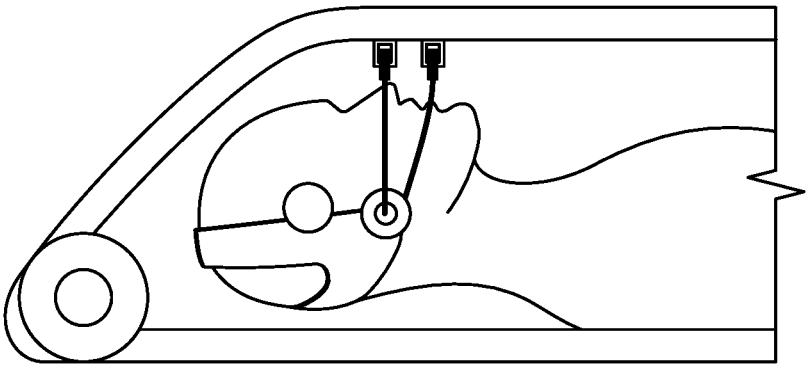

FIG. 5*d* displays another embodiment wherein the cradle 5 is connected to the upper part 4 of the apparatus with a belt.

Figure 6:
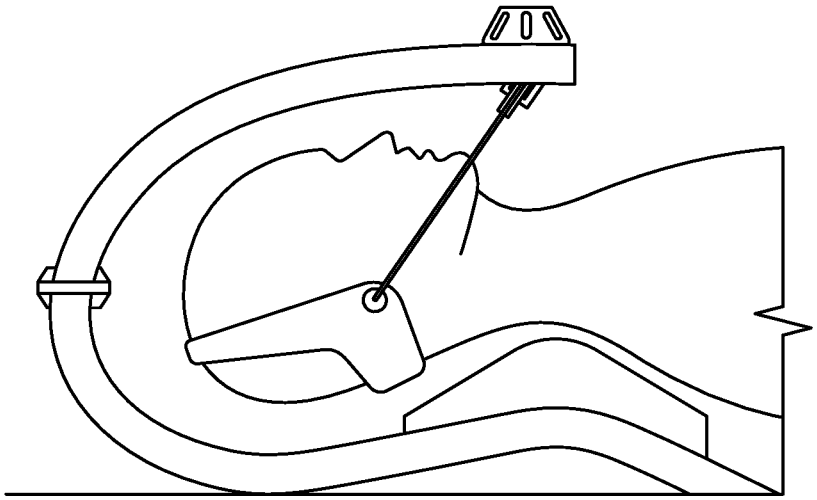
FIG. 6 is a side view of another embodiment of the present invention showing the possibility of exercising the muscles of the neck by using the tension in the wire or the flexibility of the apparatus.

FIG. 6 is a side view of a third embodiment of the present invention. In this embodiment, the user exercises the neck by pulling the head backwards. This motion can be made possible by making the wire 9 or rope flexible. Alternatively, the motion can be made possible by exploiting the flexibility of the apparatus.

The upper part 4 is bent downward to keep the distance from the cradle 5 to the attachment relatively the same as the attachment is moved outward. This creates a conical pendular movement. The invention is made for ease in the movement but resistance can be incorporated with locking and resistance in the rolling element and use of flexible resistance in the ropes.

The supporting pillow is attached to the lower element and can be moved up and down the neck. It is to provide a fixating support to the neck to provide a better focus of the movements around their axes

The invention claimed is:

1. An apparatus for exercising musculature and restoring mobility of joints in a neck of a user, wherein the apparatus comprises:

a base part with a first end;

an upper part having an end and having an elongated shape;

a connecting part between the upper part and the base part, wherein the upper part, the base part, and the connecting part define a space in which a head of a user can be placed;

a cradle attached to the upper part and in which the head of the user can rest, the cradle having a first attachment point and a second attachment point; and a neck support attached at the first end of the base part;

wherein the cradle is attached to the upper part via a slider that is slidable with respect to the upper part, and the upper part curves downwards at its end so as to maintain a distance from the cradle to the slider substantially constant as the slider is slid along the upper part; and wherein a rope or a wire connects the first attachment point and the second attachment point to a pulley or a wheel attached to the slider, so as to allow movement of the head and neck of the user around a first axis that is parallel to a rotational axis of the pulley or wheel.

2. The apparatus according to claim 1, wherein, when the user's head is resting in the cradle, the neck support is movable up and down relative to the neck of the user so as to provide fixation of movement to specify movement of the head and neck of the user.

3. The apparatus according to claim 1, wherein the cradle is provided with the first and second attachment points on opposing sides, respectively of the user's head when the user's head is resting in the cradle, so as to allow movement of the neck and head of the user around a second axis extending through a center of the first and second attachment points.

4. The apparatus according to claim 3, wherein the second axis is positioned between a skull and a first vertebra of the user when the user's head is resting in the cradle.

5. The apparatus according to claim 1 wherein each of the first and second attachment points comprises a joint.

6. The apparatus according to claim 1, wherein the first axis is centered around first and second vertebrae of the user when the user's head is resting in the cradle.

7. The apparatus according to claim 1, wherein the slider is connected to a connection point via a joint so as to allow movement of the head and neck of the user around a third axis going through a center of the head of the user from a face of the user to a back of the head of the user.

8. The apparatus according to claim 1, wherein the slider is adjustable so as to adjust an angle between the cradle and the upper part relative to an axis through a center of the head of the user from a face of the user to a back of the head of the user to target movement of the head and neck of the user to certain vertebrae of the user.

9. The apparatus according to claim 8, wherein the movement of the head and neck of the user is targeted to third to seventh vertebrae of the user.

10. The apparatus according to claim 1, wherein a slit in the upper part of the apparatus allows the slider to slide along either part of a length, or an entire length, of the upper part.

11. The apparatus according to claim 10 wherein the slider is fixable in place at any point of the slit by a tightening screw.

12. A method for exercising neck musculature and restoring joint mobility in the neck of a user utilizing the apparatus according to claim 1, the method comprising:

supporting the user's head in the cradle; and allowing movement of the head and neck of the user around at least one axis while the user's head is supported in the cradle.

13. The apparatus according to claim 3, wherein the movement of the neck and head of the user around the second axis comprises movement of the head in a nodding motion.

14. The apparatus according to claim 3, wherein the movement of the head and neck of the user around the first axis comprises a rotational movement of the head from side to side in a no, no shaking motion.

* * * * *